United States Patent [19]

Uppal

[11] Patent Number: 4,762,479

[45] Date of Patent: Aug. 9, 1988

[54] MOTOR LUBRICATION WITH NO EXTERNAL CASE DRAIN

[75] Inventor: Sohan L. Uppal, Hopkins, Minn.

[73] Assignee: Eaton Corporation, Cleveland, Ohio

[21] Appl. No.: 15,263

[22] Filed: Feb. 17, 1987

[51] Int. Cl.[4] ..... F01C 1/10; F01C 21/04; F03C 2/08

[52] U.S. Cl. ..... 418/61.3; 418/102

[58] Field of Search ..... 418/61 B, 102, 259, 418/270; 184/6.16, 31

[56] References Cited

U.S. PATENT DOCUMENTS

| | | | |
|---|---|---|---|
| 2,484,789 | 10/1949 | Hill . | |
| 3,862,814 | 1/1978 | Swedberg | 418/102 |
| 3,887,309 | 6/1975 | Easton | 418/61 B |
| 4,035,113 | 7/1977 | McDermott | 418/61 B |
| 4,343,601 | 8/1982 | Thorson | 418/61 B |
| 4,390,329 | 6/1983 | Thorson | 418/61 B |
| 4,533,302 | 8/1985 | Begley | 418/102 |
| 4,586,885 | 5/1986 | Middlekauff | 418/61 B |
| 4,619,595 | 10/1986 | Amano | 418/259 |
| 4,645,438 | 2/1987 | Dahlquist | 418/61 B |

*Primary Examiner*—John J. Vrablik

*Attorney, Agent, or Firm*—L. J. Kasper

[57] ABSTRACT

An improved lubrication system is provided for a motor of the type including a gerotor displacement mechanism (17), an inlet port (57), an outlet port (61), and valve means (19,55) operable to control the flow of fluid from the inlet port through volume chambers (29) of the displacement mechanisms and back to the outlet port, thus defining a main fluid flow path. A shuttle valve (85) communicates a flow of lubrication fluid from the main fluid flow path to a lubrication flow path (79,81,82,83) which flows through the bearings and spline connections of the motor. In accordance with the invention, a restrictor member 113 is located in the outlet port (61) and defines a restricted orifice 115 which restricts outlet flow from the motor causing a back pressure which generates the flow of lubrication fluid. After fluid flows through the lubrication flow path, it flows to the outlet port, downstream of the restricted orifice 115, recombining with the low-pressure, exhaust flow from the motor. The lubrication system of the invention permits a greater flow of lubrication fluid, without loss of volumetric efficiency, and without the need for a separate case drain port.

7 Claims, 1 Drawing Sheet

MOTOR LUBRICATION WITH NO EXTERNAL CASE DRAIN

BACKGROUND OF THE DISCLOSURE

The present invention relates to rotary fluid pressure devices such as low-speed, high-torque gerotor motors, and more particularly, to an improved lubrication flow circuit therefor.

A typical motor of the type to which the present invention relates includes a housing defining inlet and outlet ports and some type of fluid energy-translating displacement mechanism, such as a gerotor gear set. The typical motor further includes valve means to provide fluid communication between the ports and the volume chambers of the displacement mechanism. The invention is especially advantageous when used in a device wherein the displacement mechanism is a gerotor gear set including an orbiting and rotating gerotor star, and will be described in connection therewith.

In gerotor motors, an externally-splined main drive shaft (dogbone) is typically used to transmit torque from the orbiting and rotating gerotor star to the rotating output shaft. In order for the motor to have adequate operating life, it is important that these torque-transmitting spline connections be lubricated by a flow of lubricating fluid. It is also important that certain other elements of the motor be lubricated, such as any bearings which may be used to rotatably support the output shaft relative to the motor housing.

In certain prior art motors of the type described above, it has been known to provide a controlled amount of lubrication flow, in parallel with the main system flow path, by means of one or more metering notches defined by the rotary valve member, or by means of an extra amount of side clearance between the gerotor star and the adjacent housing surface. See for example, U.S. Pat. Nos. 3,572,983 and 3,862,814, both assigned to the assignee of the present invention. The lubrication flow is communicated from the main system flow path, at a location upstream of the gerotor gear set, thereby detracting from the volumetric efficiency of the motor. The resulting lubricant flow is "forward", i.e., toward the output shaft end of the motor, through the dogbone spline connections, and then through the bearings, and eventually to the outlet port.

In a recent improvement of the above-described lubrication arrangement, lubricant recesses have been provided in the end surface of the housing adjacent the internal teeth of a roller gerotor. These lubricant recesses cooperate with the clearance spaces at the ends of the gerotor rollers to generate a flow of lubricant which is then communicated to the lubrication flow path through the splines and bearings. See U.S. Pat. No. 4,533,302, also assigned to the assignee of the present invention.

Although the methods for providing lubricant flow described in the preceding two paragraphs have been in widespread commercial use and have been generally satisfactory, both methods have the disadvantage that the volume of lubricant flow is generally proportional to the load imposed on the motor, as represented by the pressure differential across the gerotor, or between the inlet and outlet ports. When a low-speed, high-torque gerotor motor is being operated at a pressure differential of 2,000 or 3,000 psi, and an output speed in the range of about 50 to 300 rpm, there typically is sufficient lubricant flow generated. However, during times when the motor is being operated at relatively high speed (e.g., 500 rpm), and at relatively low load (e.g., a pressure differential of about 500 psi), substantially less lubricant flow is generated. Unfortunately, it is during periods of such relative high-speed, low-load operation that greater lubricant flow is required because of the greater amount of rubbing action on elements such as the splines, caused by the higher speeds, and resulting in greater heat generation and an increase in contamination particles.

A solution to the above-described problem of insufficient lubrication during relatively high-speed, low-load operation is set forth in co-pending application U.S. Ser. No. 795,590, filed Nov. 6, 1985, in the name of Roland A. Dahlquist for a "gerotor motor and improved lubrication circuit therefor", now U.S. Pat. No. 4,645,438. The lubrication arrangement illustrated and described in the co-pending application provides a relatively constant flow of lubrication fluid, in parallel with the main flow path, and taken from the main flow path at a location downstream of the valving, such that the volumetric efficiency of the motor is not diminished.

The improved lubrication arrangement illustrated and described in the co-pending application does, however, have the disadvantage of requiring a separate case drain port. The lubrication fluid flows through the entire lubrication flow path, then to the case drain port and from there returns to the system reservoir. In many applications for motors of this type, the presence of a third port (i.e., the case drain port) and the associated hose and fittings, is considered undesirable by the vehicle manufacturer. This is especially true in situations where the motor is located somewhat remotely from the pump and reservoir, such that the length and cost of the hose from the case drain port back to the system reservoir becomes excessive. Also, because the case drain line is frequently a smaller and thinner hose, it is more susceptible to damage and leakage than the two main system lines.

SUMMARY OF THE INVENTION

Accordingly, it is an object of the present invention to provide a rotary fluid pressure device having an improved lubrication flow circuit, and especially, having a lubrication flow circuit in which the volume of lubricant flow is largely independent of the pressure and speed at which the motor is operating, and wherein the need for a separate case drain port and drain line is eliminated.

It is a more specific object of the present invention to provide such an improved lubrication flow circuit in which the volume of lubricant flow is relatively constant, regardless of variations in motor speed and pressure differential.

It is a further object of the present invention to provide an improved lubrication flow circuit which does not adversely affect the volumetric efficiency of the motor.

The above and other objects of the present invention are accomplished by the provision of an improved rotary fluid pressure device of the type including housing means defining a fluid inlet port and a fluid outlet port. A fluid energy-translating displacement means is associated with the housing means and includes at least one member having rotational movement relative to the housing means to define expanding and contracting fluid volume chambers during the rotational movement.

Valve means cooperates with the housing means to define a main fluid flow path providing fluid communication between the fluid inlet port and the expanding fluid volume chambers and between the contracting fluid volume chambers and the fluid outlet port. An output shaft means is supported for rotation relative to the housing means, and the device includes means for transmitting torque from the one member of the displacement means which has rotational movement to the output shaft means. The device further includes means defining a lubrication flow path including the torque-transmitting means.

The improved device is characterized by the housing means defining outlet flow passage means communicating from the valve means to the fluid outlet port and comprising a portion of the main fluid flow path. A fluid flow restriction means is disposed in one of the outlet flow passage means and the fluid outlet port, the fluid flow restriction means being operable to provide a substantial fluid pressure differential thereacross. The device includes means operable to communicate a flow of lubrication fluid from the outlet flow passage means to the lubrication flow path, and means defining a lubrication drain passage means providing fluid communication between the lubrication flow path and either the outlet flow passage means or the fluid outlet port, downstream of said fluid flow restriction means.

DESCRIPTION OF THE PREFERRED EMBODIMENTS

Figure 1:
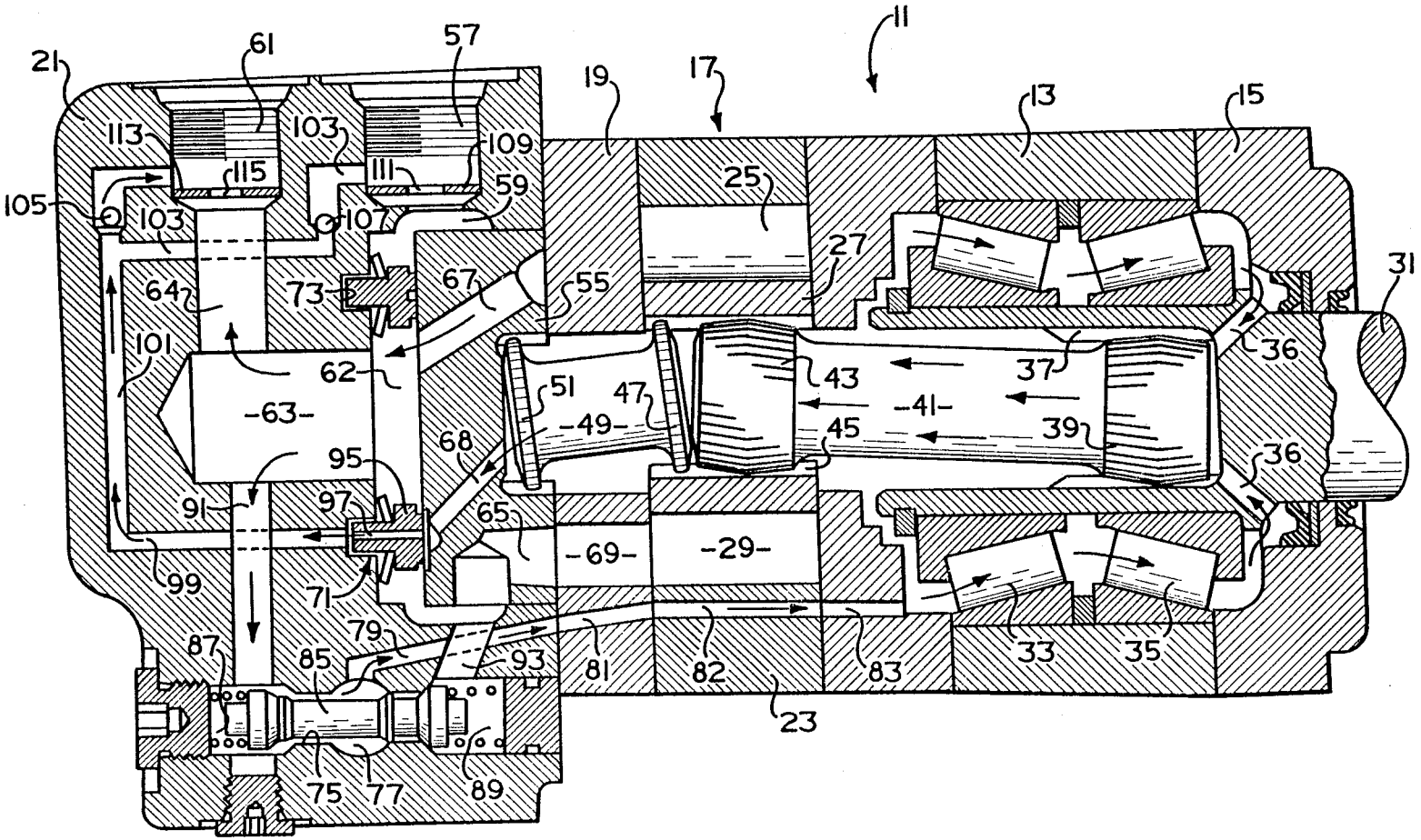
FIG. 1 is an axial cross-section of a low-speed, high-torque gerotor motor utilizing the improved lubrication flow circuit of the present invention.

Referring now to the drawings, which are not intended to limit the invention, FIG. 1 illustrates a low-speed, high-torque gerotor motor of the type to which the present invention may be applied, and which is illustrated and described in greater detail in U.S. Pat. Nos. 3,572,983, 3,862,814, and 4,343,600, both of which are assigned to the assignee of the present invention and are incorporated herein by reference.

The hydraulic motor shown in FIG. 1 comprises a plurality of sections secured together, such as by a plurality of bolts (not shown). The motor, generally designated 11, includes a shaft support casing 13, a front cover 15, a gerotor displacement mechanism 17, a port plate 19, and a valve housing portion 21.

The gerotor displacement mechanism 17 is well known in the art, is shown and described in great detail in the incorporated patents, and will be described only briefly herein. More specifically, the displacement mechanism 17 is a roller gerotor comprising an internally-toothed ring 23 defining a plurality of generally semi-cylindrical pockets or openings, with a cylindrical roller member 25 disposed in each of the openings. Eccentrically disposed within the ring 23 is an externally-toothed star 27, typically having one less external tooth than the number of cylindrical rollers 25, thus permitting the star 27 to orbit and rotate relative to the ring 23. The relative orbital and rotational movement between the ring 23 and star 27 defines a plurality of expanding and contracting volume chambers 29.

Referring still to FIG. 1, the motor includes an output shaft 31 positioned within the shaft support casing 13 and rotatably supported therein by suitable bearing sets 33 and 35. The shaft 31 defines a pair of angled fluid passages 36 which will be referenced subsequently in connection with the lubrication flow circuit of the invention. The shaft 31 includes a set of internal, straight splines 37, and in engagement therewith is a set of external, crowned splines 39 formed on one end of a main drive shaft 41. Disposed at the opposite end of the main drive shaft 41 is another set of external, crowned splines 43, in engagement with a set of internal, straight splines 45, formed on the inside diameter of the star 27. Therefore, in the subject embodiment, because the ring 23 includes seven internal teeth 25, and the star 27 includes six external teeth, six orbits of the star 27 result in one complete rotation thereof, and one complete rotation of the main drive shaft 41 and the output shaft 31.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55. The valve member 55 is rotatably disposed within the valve housing 21. The valve drive shaft 49 is splined to both the star 27 and the valve member 55 in order to maintain proper valve timing therebetween, as is generally well known in the art.

The valve housing 21 includes a fluid inlet port 57 in communication with an annular chamber 59 which surrounds the valve member 55. The valve housing 21 also includes a fluid outlet port 61 which is in fluid communication with a chamber 62 disposed between the valve housing 21 and valve member 55. The chamber 62 is in fluid communication with the outlet port 61 through an axial bore 63 and a radial bore 64. The valve member 55 defines a plurality of alternating valve passages 65 and 67, the passages 65 being in continuous fluid communication with the annular chamber 59, and the passages 67 being in continuous fluid communication with the chamber 63. In the subject embodiment, there are six of the passages 65, and six of the passages 67, corresponding to the six external teeth of the star 27. The valve member 55 also defines an angled drain passage 68 which will be discussed further subsequently. The port plate 19 defines a plurality of fluid passages 69 (only one of which is shown in FIG. 1), each of which is disposed to be in continuous fluid communication with the adjacent volume chamber 29.

As is well known to those skilled in the art, it is necessary to maintain the valve member 55 in sealing engagement with the adjacent surface of the port plate 19, to prevent cross port leakage between the fluid chambers 59 and 63. To effect such sealing, a valve seating mechanism 71 is included, seated within an annular groove 73 defined by the valve housing 21, and separates the annular chamber 59 from the chamber 62. The valve seating mechanism 71 is well known in the art (see previously cited U.S. Pat. No. 3,572,983) and will not be described in detail herein.

The general operation of the low-speed, high-torque gerotor motor shown in FIG. 1 is well known to those skilled in the art and is described in detail in the above-incorporated patents. For purposes of this description, it is sufficient to note that, for example, high-pressure fluid may be communicated to the inlet port 57 and from there will flow through the chamber 59, the valve passages 65, the fluid passages 69, and enter the expanding volume chambers 29, causing the rotor 27 to orbit and rotate. This movement of the rotor 27 will be transmitted by means of the main drive shaft 41 to the output shaft 31, causing rotation thereof. As the rotor 27 orbits and rotates, low-pressure fluid is exhausted from the contracting volume chambers 29 and is communicated through the respective fluid passages 69 and valve passages 67 to the fluid chamber 62, and then out to the fluid port 61. As will be understood by those skilled in the art, the path described above by which fluid flows from the inlet port 57 to the outlet port 61 is considered the "main fluid flow path" of the motor. The pressure drop from the port 57 to the port 61 is representative of the load on the motor, and the rate of fluid flow through the above-described path is representative of the output speed of the motor, i.e., the speed of rotation of the output shaft 31.

Lubrication Flow Path

The valve housing portion 21 defines a stepped, axially-oriented bore 75. In communication with the bore 75 is a transverse bore 77 which, in turn, communicates with an axial lubricant passage 79. The passage 79 in turn communicates with an axial lubricant passage 81, defined by the port plate 19, then with an axial lubricant passage 82 defined by the gerotor ring 23, and finally, with an axial lubricant passage 83, defined by the shaft support casing 13.

Disposed within the axial bore 75 is a shuttle valve 85 which cooperates with the valve housing portion 21 to define, at its opposite ends, a pair of pressure chambers 87 and 89. A radial fluid passage 91 communicates between the axial bore 63 and the pressure chamber 87, and similarly, a radial fluid passage 93 communicates between the annular chamber 59 and the pressure chamber 89.

The valve seating mechanism 71 comprises an annular balancing ring member 95 which defines a drain passage 97 disposed to communicate lubrication fluid from the angled drain passage 68 to the annular groove 73.

The valve housing portion 21 defines an axial drain passage 99 having its upstream end in communication with the annular groove 73 and its downstream end in communication with a transverse drain passage 101. At the downstream end of the drain passage 101, another axial drain passage 103 branches off from the passage 101, such that the drain passage 101 is in open communication with the outlet port 61 whereas the drain passage 103 is in open communication with the inlet port 57. A ball check valve 105 is disposed in the drain passage 101, and a ball check valve 107 is disposed in the drain passage 103, each of the check valves 105 and 107 being operable to seat against suitable valve seats defined by the drain passages 101 and 103, respectively.

Disposed in the inlet port 57 is a restrictor member 109 defining a restricted orifice 111. Similarly, disposed in the outlet port 61 is a restrictor member 113 defining a restricted orifice 115. The function and operation of the various elements 75 through 115 described above will become apparent in connection with the following description of the lubrication flow path of the invention. For purposes of the subsequent description, it will be assumed that high-pressure fluid is communicated to the inlet port 57, while low-pressure, exhaust fluid is communicated away from the outlet port 61, in the same manner as set forth in the previous description of the operation of the main flow path.

In a typical motor of the type illustrated and described herein, the fluid pressure in the chamber 62 would be approximately zero, i.e., approximately the same as the pressure in the system reservoir. However, in the lubrication system of the present invention, flow of low-pressure exhaust fluid from the chamber 62 flows through the bores 63 and 64, and through the restricted orifice 115, and then through the outlet ports 61. This flow results in a substantial pressure differential across the restricted orifice 115, the size of the orifice 115 being selected to provide a predetermined fluid pressure in the bores 63 and 64, and also in the radial fluid passage 91. In the subject embodiment, the restricted orifice 115 is sized to cause a "back pressure" of approximately 50 psi in the bores 63 and 64 and in the passage 91. It will be understood by those skilled in the art that the desired back pressure may be more or less than 50 psi and, in any particular motor application, the amount of back pressure to be generated will be determined primarily by the amount of flow needed to achieve sufficient lubrication and cooling.

High-pressure fluid in the inlet port 57 causes the ball check valve 107 to seat, and at the same time, is communicated from the annular chamber 59 through the radial fluid passage 93 to the pressure chamber 89, biasing the shuttle valve 85 to the left in FIG. 1 to the position shown. The result is relatively open communication of fluid in the passage 91 through the bores 75 and 77 to the axial lubricant passages 79, 81, 82, and 83. Thus, in the subject embodiment, it is the shuttle valve 85 which provides a flow of lubrication fluid to the lubrication fluid path.

Lubrication fluid which flows out of the axial lubricant passage 83 flows through the bearing sets 33 and 35 and then inwardly through the angled fluid passages 36 to the interior cavity defined by the output shaft 31. Lubrication fluid then flows through the forward connection comprising the splines 37 and 39, then flows rearwardly (see arrows) through the rearward connection comprising the splines 43 and 45. Lubrication fluid then flows through the splines 47 and 51 of the valve timing shaft 49, then flows through the angled drain passage 68 and through the drain passage 97 into the drain passages 99 and 101. The lubrication fluid flows past the ball check valve 105 and then into the outlet port 61, downstream of the restricted orifice 115, the fluid pressure in the outlet port 61 being at approximately the same pressure as the system reservoir. Although the restrictor members 109 and 113 have been illustrated herein as simple, annular members, it should be appreciated by those skilled in the art that this illustration is by way of example only, and partly for ease of illustration. Preferably, the restriction means which defines the restricted orifices 111 and 115 should be some sort of restriction arrangement which permits relatively free, unrestricted flow of fluid from the port into the motor, but substantially restricts flow of fluid from the motor out through the port, thus providing the desired back pressure to generate the lubrication flow.

Thus, it may be seen that the present invention provides a lubrication system in which lubrication fluid is communicated from the main flow path, from a location downstream of the displacement mechanism and valving, such that the volumetric efficiency of the motor is not diminished. The restricted orifice which is placed in the outlet flow path provides a sufficient back pressure to generate the lubrication flow, and at the same time, permits the lubrication flow to recombine with the outlet flow from the motor, downstream of the restricted orifice, thus eliminating the need for a separate case drain port.

The invention has been described in great detail, sufficient to enable one skilled in the art to make and use the same. Various alterations and modifications of the invention will occur to those skilled in the art upon a reading and understanding of the foregoing specification, and it is intended to include all such alterations and modifications as part of the invention, insofar as they come within the scope of the appended claims.

I claim:

1. A rotary fluid pressure device of the type including housing means defining a fluid inlet port and a fluid outlet port; fluid energy-translating displacement means associated with said housing means and including at least one member having rotational movement relative to said housing means to define expanding and contracting fluid volume chambers during said rotational movement; valve means cooperating with said housing means to define a main fluid flow path providing fluid communication between said fluid inlet port and said expanding fluid volume chambers and between said contracting fluid volume chambers and said fluid outlet port; output shaft means supported for rotation relative to said housing means; means for transmitting torque from said one member of said displacement means having rotational movement to said output shaft means; and means defining a lubrication flow path including said torque-transmitting means, characterized by:

(a) said housing means defining outlet flow passage means communicating from said valve means to said fluid outlet port and comprising a portion of said main fluid flow path;

(b) fluid flow restriction means disposed in one of said outlet flow passage means and said fluid outlet port, said fluid flow restriction means being operable to provide a substantial fluid pressure differential thereacross;

(c) means operable to communicate a flow of lubrication fluid from said outlet flow passage means to said lubrication fluid path; and (d) means defining lubrication drain passage means providing fluid communication between said lubrication flow path and one of said outlet flow passage means and said fluid outlet port, downstream of said fluid flow restriction means.

2. A rotary fluid pressure device as claimed in claim 1 characterized by said fluid energy-translating displacement means comprising an internally-toothed member and an externally-toothed member eccentrically disposed within said internally-toothed member for relative orbital and rotational movement therebetween.

3. A rotary fluid pressure device as claimed in claim 2 characterized by said valve means comprising a stationary valve member defining a plurality of stationary fluid ports, each of which is in continuous fluid communication with one of said expanding and contracting fluid volume chambers, said valve means further comprising a rotary valve member being movable in synchronism with one of said relative movements of said internally- and externally-toothed members and defining valve passages providing fluid communication between said fluid inlet and outlet ports and said stationary fluid ports.

4. A rotary fluid pressure device as claimed in claim 1 characterized by bearing means disposed radially between said output shaft means and said housing means, said lubrication flow path including, in the order indicated:

(a) flow through said bearing means; and (b) flow through said means for transmitting torque.

5. A rotary fluid pressure device as claimed in claim 1 characterized by said means for transmitting torque comprising a main drive shaft cooperating with said output shaft means to define a forward connection means and cooperating with said one member having rotational movement to define a rearward connection means, said lubrication flow path including said forward and rearward connection means.

6. A rotary fluid pressure device as claimed in claim 1 characterized by said means operable to communicate a flow of lubrication fluid comprising a valve means disposed in series flow relationship between said outlet flow passage means and said means defining a lubrication flow path.

7. A rotary fluid pressure device as claimed in claim 6 characterized by said valve means comprising a shuttle valve having a high pressure end in fluid communication with said main fluid flow path upstream of said expanding fluid volume chambers, a low pressure end in fluid communication with said main fluid flow path downstream of said contracting fluid volume chambers, and an outlet in fluid communication with said lubrication flow path.

* * * * *